United States Patent [19]

McQuilkin

[11] Patent Number: 4,956,008

[45] Date of Patent: Sep. 11, 1990

[54] APPARATUS FOR SUPERPLASTIC FORMING AND EJECTION OF A PART FROM A DIE

[75] Inventor: Frederick T. McQuilkin, Los Angeles, Calif.

[73] Assignee: Rockwell International Corporation, El Segundo, Calif.

[21] Appl. No.: 909,545

[22] Filed: Sep. 22, 1986

[51] Int. Cl.[5] ..... B21D 45/02

[52] U.S. Cl. ..... 72/427; 72/709; 164/344

[58] Field of Search ..... 164/342, 344, 404, 131, 164/347; 249/66 R, 66 A, 112; 425/437, 444; 72/427, 709

[56] References Cited

U.S. PATENT DOCUMENTS

| | | | |
|---|---|---|---|
| 3,572,424 | 3/1971 | Byrne | 164/131 |
| 3,662,815 | 5/1972 | Bouyt | 164/344 |

FOREIGN PATENT DOCUMENTS

| | | | |
|---|---|---|---|
| 782951 | 7/1935 | France | 164/344 |
| 977106A | 12/1982 | U.S.S.R. | 164/404 |

*Primary Examiner*—Richard K. Seidel

*Attorney, Agent, or Firm*—Charles T. Silberberg; Harold C. Weston

[57] ABSTRACT

An apparatus for superplastric forming of metallic workpieces and, more particularly, aluminum workpieces is disclosed. The apparatus includes a mechanism for ejecting the workpiece from the die upon completion of the superplastic forming process. A steel liner covers the surface of the die cavity, and the workpiece is formed against the liner (which acts as a die surface). The steel liner has high temperature resistance at superplastic forming temperatures providing it with sufficient rigidity to enable it to be removed from the cavity at or near superplastic forming temperatures while still retaining its shape and that of the formed worpiece which it supports. In one embodiment, a cam operated ejection mechanism pushes the liner from the die cavity surface as desired at the end of the superplastic forming process. In another embodiment, the die is provided with apertures through which pressurized gas is directed toward the liner pushing the liner away from the die cavity surface.

7 Claims, 1 Drawing Sheet

APPARATUS FOR SUPERPLASTIC FORMING AND EJECTION OF A PART FROM A DIE

BACKGROUND OF THE INVENTION

1. Field of the Invention

The present invention is in the field of superplastic forming of metallic workpieces and, more particularly, to workpieces composed of aluminum.

2. Description of the Prior Art

Superplastic metals are known in the art as materials that provide the strength of conventional metals and the elongation and formability characteristics of conventional plastic materials. However, at superplastic forming temperatures, the metallic workpieces may warp and/or distort if removed from the die or otherwise handled without proper support. Thus, prior art devices and superplastic forming systems typically require that the metallic workpiece be allowed to cool before handling or removal from the die.

Many prior art systems seek to facilitate removal of the workpieces from the die by making the die with a relatively high degree of draft. The draft tends to prevent the workpiece from fitting too snugly within the die cavity causing binding at some of the edges or corners and impeding removal therefrom. Without a draft, the workpiece would have to be pulled straight up out of the die with the sides of the workpiece in sliding contact with the sides of the die. Thus, a relatively high degree of draft allows the part to be more easily slipped out of the die cavity. However, using such a high degree of draft in the die necessarily places important limitations on the shape of the die and on the shape that the die may impart to the workpiece.

Another prior art system incorporates a two piece die one of which is provided with an aperture. After a workpiece is superplastically formed in the die cavity between the pieces, a vacuum is applied at the aperture to draw the workpiece up against one of the die halves. The vacuum holds the workpiece against the die half so that the upper die half can be lifted from the lower die half carrying the workpiece with it. However, the disadvantage with this system is that support is not provided at all points of the workpiece surface adjacent the upper die half. Moreover, the entire upper die half and workpiece must be cooled before the die can be reused to superplastically form another workpiece. Two examples of such a prior art system are disclosed in U.S. Pat. Nos. 4,381,657 and 4,502,309 both to Hamilton.

Other prior art devices have used suitably positioned pins to eject the workpiece from the die after completion of the superplastic forming process. The pins are mounted in the die and abut the workpiece. When actuated, the pins push the workpiece away from the die. However, a major disadvantage with this prior art system is that if the pins are actuated when the workpiece is too hot, the pins may puncture or otherwise damage the workpiece. In addition, with such systems the workpiece must be of a sufficient thickness to withstand the force imparted by the moving pins. Consequently, due to these limitations in use, the pin ejection system is only of marginal benefit in removing a workpiece from a die.

Still other prior art systems have attempted to facilitate removal of the workpiece from the die by positioning the die member containing the cavity upside down. Thus, at the end of the superplastic forming process when the lower die member is separated from the upper member, the workpiece can simply fall out of the die cavity. As with the other prior art devices described herein above, this system must also allow the workpiece to cool before separation from the die in order to avoid warpage and/or damage to the workpiece caused by excessive handling or premature removal from the die. Thus, since the workpiece must be allowed to cool before removal, the production time for superplastical forming using this prior art system is inordinately long.

In conclusion, since support is needed for the workpiece while it is still in a superplastic state to prevent warpage and distortion, prior art systems currently in use typically require the superplastically formed part to cool to a substantial degree while still within the die. Consequently, using prior art systems, production of superplastically formed parts requires that the entire die and workpiece together be allowed to cool down before the workpiece may be handled separate therefrom. The cooling down period may be inordinately long if the die and workpiece are very large and hold a lot of heat energy. Thus this required cooling off period results in relatively long production times required to superplastically form a desired part.

SUMMARY OF INVENTION

It is a principal object of the present invention to provide a die cavity liner which provides support to the workpiece when both the liner and workpiece together are removed from the die cavity.

It is an object of the present invention to provide a means for supporting a workpiece while it is at or near superplastic forming temperatures and separated from the die.

It is another object of the present invention to provide a means for ejecting a workpiece from a die after completion of the superplastic forming process.

It is still another object of the invention to provide a superplastic forming apparatus which allows the incorporation of a die with a minimal degree of draft.

It is also another object of the present invention to provide a superplastic forming apparatus which can expedite the superplastic forming production process.

The system of the present invention is a superplastic forming apparatus which incorporates a heat resistant liner for the die cavity surface. The liner alone provides enough support for the workpiece to allow the workpiece to be carried therein when the liner is removed from the die cavity upon completion of the superplastic forming process. Thus, since the workpiece can be removed from the die immediately after completion of the superplastic forming process, an important advantage of the system is that it allows the die to be immediately used to superplastically form another workpiece without having to be reheated to a significant degree.

The apparatus of the present invention also incorporates a means for ejecting the liner and the workpiece together from the die. An important feature of the present invention is that it enables the workpiece to be quickly ejected from the die at completion of the superplastic forming process thereby greatly expediting the production process.

Generally, the system of the invention includes a die having a liner covering the die cavity surface. The workpiece is placed on the surface of the liner rather than directly on the surface of the die cavity. The liner is composed of steel or other material which can withstand the high temperatures of superplastic forming while still retaining its rigidity. Because it retains its rigidity, it can provide sufficient support to the workpiece at high temperatures to enable the liner and workpiece to be removed together as a unit from the die cavity immediately upon completion of the superplastic forming process. Consequently, another workpiece can be positioned within the die immediately after the first workpiece has been superplastically formed before the die has cooled appreciably. Minimum heat energy is lost between the superplastic forming of successive workpieces. This helps to minimize the energy expenditure otherwise required for the superplastic forming production process. In addition, prompt removal of the workpiece after superplastic forming thereof minimizes the amount of time between superplastic forming of one workpiece and initiation of the superplastic forming of the next successive workpiece thereby expediting the entire production process.

Since the workpiece superplastically forms against the die at the nigh superplastic forming temperatures, this results in a tight fit between the workpiece and the die at (and possibly significantly below) these temperatures. For this reason, prior art systems may use a high degree of draft in the die cavity to facilitate removal. But, since the liner and workpiece can be removed from the hot die and allowed to cool separately therefrom, the liner and workpiece can cool sufficiently to permit the workpiece to contract enough to alleviate the tight fit between the workpiece and the liner. This facilitates removal of the workpiece from the liner and obviates the need for a high degree of draft in the die and/or the liner.

The system of the present invention also includes a means for forcibly ejecting the workpiece and liner from the die. In one embodiment of the invention, the ejection means includes a pair of apertures provided in the die and located at a central portion of the die cavity surface. The apertures connect the surface of the die cavity to an outer surface of the die enabling pressurized gas to be directed through the apertures toward the liner and workpiece combination. The force of the pressurized gas pushes the liner and workpiece away from the die. In another embodiment of the invention, the ejection means includes a cam positioned within the die. The cam is positioned proximal to the die cavity surface so that upon rotation of the cam a lobe of the cam moves against the liner pushing the liner away from the die. The ejection means further expedites the production of superplastically formed parts by eliminating the relatively slow manual separation of the liner from the die. Thus, in contrast to prior art systems which require having the workpiece cool considerably before removal resulting in a very slow production line superplastic forming process, the system of the present invention results in a very speedy superplastic forming production line process.

Other objects and advantages of the present invention will be apparent from the following detailed description and the drawings.

DETAILED DESCRIPTION THE PREFERRED EMBODIMENT

Figure 1:
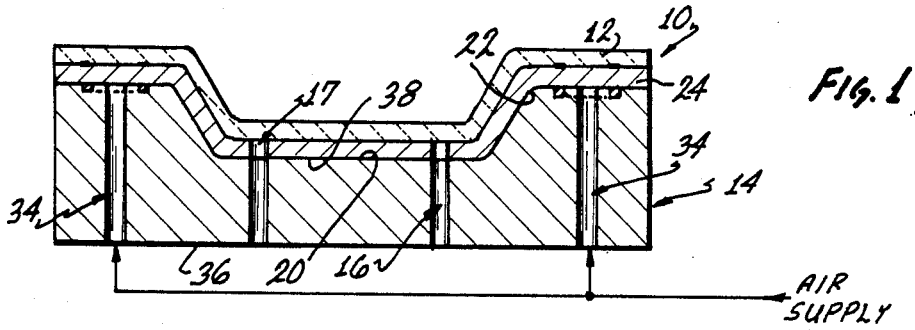
FIG. 1 is a perspective view of the system of the present invention showing the liner positioned within the die cavity.

Referring now to the drawings, the tooling system of the present invention is generally designated by the numeral 10. The workpiece which is to be superplastically formed using the tooling system of the present invention 10 is generally designated by the numeral 12. A die 14 preferably comprises an upper die member (not shown) and a lower die member 18. The lower die member 18 has a face or surface 22 which defines die cavity 20. A liner 24 covers preferably the entire surface 22 of the die cavity 20. Liner 24 preferably conforms to the contours and surface irregularities or patterns of the die cavity surface 22.

The workpiece 12 is positioned in the die cavity 20 on the surface 26 of the liner 24. The contour and surface irregularities of the surface 26 of the liner 24 are imparted to the workpiece through the superplastic forming process. Although the inner surface 26 of the liner preferably is of the same contour and surface pattern, if any, as the surface of the die cavity, the surface 26 may be different from the die cavity surface in order to allow a variety of liners 24 having differently shaped surfaces and surface patterns to be used with a single die. This provides more versatility to the system by allowing a variety of differently shaped and surface patterned workpieces to be superplastically formed using a single die. The die members are both appropriately positioned in a suitable hydraulic press (not shown) or other conventional press as may be suitable for superplastic forming.

The liner 24 is preferably composed of a heat resistant material (different from the workpiece) which enables the liner 24 to remain generally rigid at the high temperatures of the superplastic forming process. Thus, the rigidity of the liner 24 enables it to provide support to the workpiece at superplastic forming temperatures when the workpiece is in a plastic state. Consequently, the workpiece may be carried in the liner 24 while at or near superplastic forming temperatures. Thus, the liner together with the workpiece may be separated from the die cavity at the completion of the forming process while still at or near superplastic forming temperatures. Due to its heat resistant properties and to its thickness, the liner has sufficient structural rigidity to provide support to the workpiece enabling the workpiece to maintain its desired shape while separated from the die. Depending on its composition, the liner's inner surface 26 may be coated with a suitable stop off material to prevent bonding of the workpiece to the liner 24. The composition of the liner is preferably steel which provides it with excellent heat resistant properties and sufficient strength to allow it to be relatively thin to minimize the heat energy required to bring it back up to superplastic forming temperatures when it is reinserted into the die cavity.

Incorporation of the steel liner allows both the liner and workpiece together to be removed from the die manually by using the appropriate tools. However, it is preferable that the liner and workpiece be separated from the die cavity mechanically in order to automate the entire superplastic forming production process. For this reason, ejection means are provided to separate the liner together with the workpiece from the die to a sufficient degree to allow the workpiece and liner to be lifted or otherwise removed from the die using the appropriate tools or a suitable apparatus.

Figure 2:
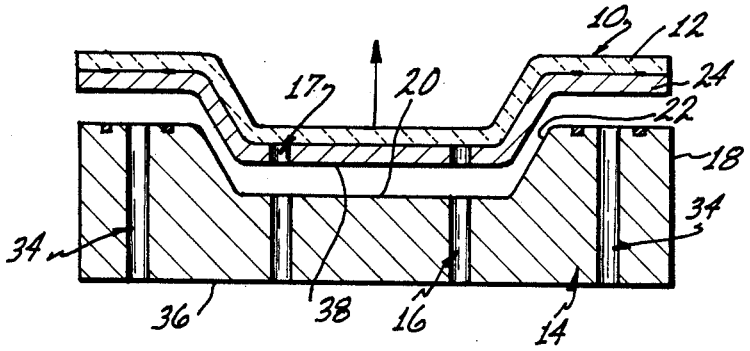
FIG. 2 is an exploded view of the system of the present invention showing the liner separated from the die.
Figure 3:
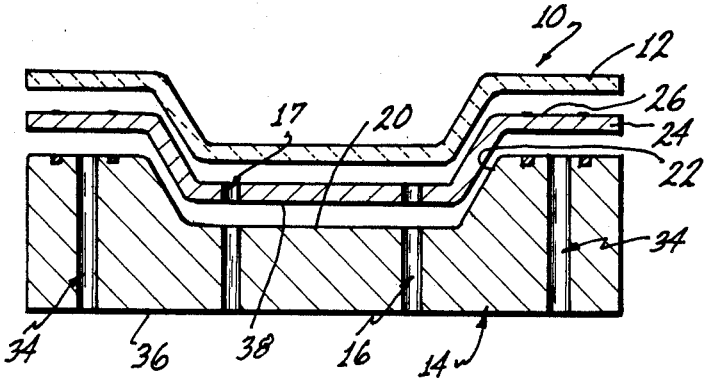
FIG. 3 is a cross-sectional view of the die showing the apertures incorporated in one embodiment of the invention.
Figure 4:
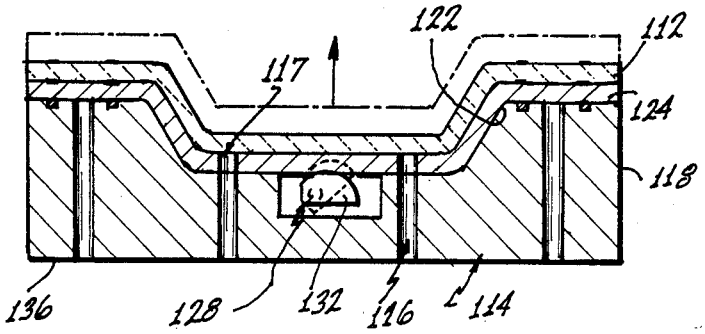
FIG. 4 is a cross-sectional view of the system of the present invention showing the cam incorporated in the second embodiment of the invention.

In one embodiment 10 of the invention, an ejection means includes apertures 34 in die 14 preferably in the lower die member 18. The apertures 34 are located at the surface 22 of the die cavity 20 preferably near the lateral edges of the die, as shown in FIGS. 1–3. The apertures 34 preferably connect the die cavity surface 22 to a lower surface 36 of the lower die member 18. Thus, the apertures 34 are preferably positioned approximately perpendicular to the lower surface 38 of the liner adjacent the die cavity. The perpendicular positioning of the apertures 34 allows pressurized gas from a suitable source (not shown) to be emitted into the apertures and directed toward the lower surface of the liner. For example, gas lines (not shown) may connect the apertures 34 to the pressurized gas source and admit the gas into the apertures 34. The source of pressurized gas may simply be a suitable compressor (not shown) with the flow of pressurized gas therefrom into the apertures controlled by a suitable solenoid valve (not shown). This solenoid valve operation provides fast and easy control of the separation procedure to further automate the superplastic forming production process. The pressurized gas provides a sufficient force to push the liner 24 and workpiece 12 away from the die. Thus, the workpiece and liner may be quickly separated from the die and the workpiece and liner allowed to cool while separated therefrom. During the cooling of the workpiece 12 and liner 24, another liner and workpiece may be positioned in the die cavity while it is still at or near the superplastic forming temperature. This reduces the energy expenditures otherwise required with prior art systems to reheat the die after it has cooled to a low enough temperature to permit removal of the workpiece therefrom. Thus, the liner and ejection subsystem save time and reduce energy cost in a superplastic forming production process.

The apertures 34 could alternatively be a plurality of apertures connecting the die cavity surface to an outer surface of the die; the plurality of apertures 34 are preferably evenly spaced and preferably positioned relative to the center of gravity of the liner 24 so as to balance the forces exerted on the liner by the pressurized gas. In addition, rather than having the apertures connect the lower surface 36 of the die to the surface 22 of the die cavity, apertures 34 may connect to any suitable surface of the die at which the gas pressure lines may connect to the apertures. In addition, the apertures may also alternatively be merely oblique to the die cavity surface rather than perpendicular.

Apertures 16 in die member 18 and apertures 17 in liner 24 are in general alignment to provide a passageway between the surface 38 of the liner and an outer surface (preferably surface 22) of the lower die member 18. Thus, pressurized gas can be emitted (or vacuum applied) into the lower die member 18 though apertures 16 and through apertures 17 in the liner 24 to provide either back pressure or vacuum to the workpiece during the superplastic forming process.

In a second embodiment of the invention, a means for ejecting the liner 124 and workpiece 112 from the die includes a cam 128 rotatably mounted in a chamber 130 in the die 114. The cam 128 has a lobe 132. The cam 128 is positioned proximal a lower surface 134 of the liner 124 so that upon rotation of the cam, the high point of the lobe 132 contacts the surface 134 of the liner to push the liner away from the die. The cam 128 may be rotated manually or by use of a suitable source of power; the source of power used to drive the cam is preferably electrical. If an electrical motor (not shown) is used to drive the cam 128, an electrical switch (not shown) may be included with the system to further automate the superplastic forming process.

From the foregoing, it is apparent that the die liner and ejection means provide a superplastic forming system which is fast, energy efficient and economical. The system enables superplastic forming to be done on a production line basis. It is to be understood that all terms used herein are descriptive rather than limiting. Although the invention has been described in conjunction with specific embodiments set forth above, many alternative embodiments, modifications and variations will be apparent to those skilled in the art in light of the disclosure set forth herein. Accordingly, it is intended to include all such alternatives, embodiments, modifications and variations that fall within the spirit and the scope of the invention as set forth in the claims hereinbelow.

I claim:

1. An apparatus for superplastic forming and ejection from its die of a metallic workpiece, comprising:

a die, said die having a face at least a portion of which defines a cavity;

a liner, said liner removably positioned in said cavity, said liner having a first surface positioned adjacent said face, the workpiece positioned to form against said liner on a second surface of said liner opposite said first surface; and ejecting means for ejecting the liner with the formed workpiece thereon from the cavity, said ejecting means including:

a rotary cam mounted in said die, said cam positioned proximal said first liner surface adjacent said die face so that a lobe of said cam movably contacts said liner to move the liner away from said die upon rotation of said cam;

means for rotating said cam, said means for rotating operably connected to said cam.

2. The apparatus of claim 1 wherein said liner is composed of a high temperature resistant material which is different from that of said metallic workpiece and which substantially retains its rigidity within a temperature range used for superplastic forming of said metallic workpiece.

3. An apparatus for superplastic forming and ejection from its die of a metallic workpiece, comprising:

a die, said die having a face at least a portion of which defines a cavity;

a liner, said liner removably positioned in said cavity, said liner having a first surface positioned adjacent said face, the workpiece positioned to form against said liner on a second surface of said liner opposite said first surface; and ejecting means for ejecting the liner with the formed workpiece thereon from the cavity, said ejecting means including:

means for providing fluid communication to said first liner surface adjacent said die face, said means for providing fluid communication providing fluid communication in a direction generally toward said first liner surface, means for directing pressurized gas from said source toward said first liner surface in order to forcibly separate said liner from said die, said source communicatingly connected to said means for directing.

4. The apparatus of claim 3 wherein said means for providing fluid communication includes said die having at least one aperture therein for providing a passageway between an outer surface of said die and said cavity, the passageway allowing said pressurized gas to be directed to said first liner surface adjacent said die face in a direction approximately normal thereto.

5. The apparatus of claim 3 wherein said liner is composed of a high temperature resistant material which is different from that of said metallic workpiece and which substantially retains its rigidity within a temperature range used for superplastic forming of said metallic workpiece.

6. An apparatus for superplastic forming and ejection from its die of a metallic workpiece, comprising:

a die, said die having a face at least a portion of which defines a cavity;

a liner, said liner removably positioned in said cavity, said liner having a first surface positioned adjacent said face, the workpiece positioned to form against said liner on a second surface of said liner opposite said first surface, said liner being composed of a high temperature resistant material which is different from that of said metallic workpiece and which substantially retains its rigidity within the temperature range used for superplastic forming of said metallic workpiece, said high temperature resistant material being steel; and means for ejecting the liner with the formed workpiece thereon from the cavity.

7. An apparatus for superplastic forming of a metallic workpiece, comprising:

a die, said die having a face at least a portion of which defines a cavity;

a liner, said liner removably positioned in said cavity, said liner having a first surface positioned adjacent said face, the workpiece positioned to form against said liner on a second surface of said liner opposite said first surface, said liner composed of a high temperature resistant material which is different from that of said metallic workpiece and which substantially retains it rigidity within the temperature range used for superplastic forming of said metallic workpiece, said high temperature resistant material being steel.

* * * * *